US010655864B2

(12) United States Patent
Howard et al.

(10) Patent No.: US 10,655,864 B2
(45) Date of Patent: May 19, 2020

(54) DEEP-EMBOSSED SUMP AND HEATING ELEMENT FOR AN OVEN

(71) Applicant: Electrolux Home Products, Inc., Charlotte, NC (US)

(72) Inventors: Michael Anthony Howard, Gallatin, TN (US); Todd Brooks, Springfield, TN (US); Rhea-Anne Pendley, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 77 days.

(21) Appl. No.: 15/593,577

(22) Filed: May 12, 2017

(65) Prior Publication Data

US 2018/0328590 A1 Nov. 15, 2018

(51) Int. Cl.

| | |
|---|---|
| ***F24C 15/16*** | (2006.01) |
| ***F24C 15/00*** | (2006.01) |
| ***F24C 7/06*** | (2006.01) |
| ***F24C 15/08*** | (2006.01) |

(52) U.S. Cl.

CPC ..... *F24C 15/16* (2013.01); *F24C 7/06* (2013.01); *F24C 15/003* (2013.01); *F24C 15/08* (2013.01)

(58) Field of Classification Search

CPC .. F24C 7/00; F24C 7/043; F24C 7/046; F24C 15/027; F24C 15/16; F24C 15/18

USPC ..... 219/403, 406

See application file for complete search history.

(56) References Cited

U.S. PATENT DOCUMENTS

| | | | | | |
|---|---|---|---|---|---|
| 1,141,175 | A | * | 6/1915 | Copeman | F24C 15/102 219/403 |
| 1,784,201 | A | * | 12/1930 | Pickup | F24C 7/04 219/403 |
| 2,465,577 | A | * | 3/1949 | Cox | A47J 37/0814 99/341 |
| 2,725,454 | A | * | 11/1955 | Wilcox | F24C 7/06 219/395 |
| 2,767,298 | A | * | 10/1956 | Fry | F24C 7/06 126/19 R |
| 3,161,755 | A | * | 12/1964 | Tilus | F24C 7/06 219/403 |
| 3,270,660 | A | * | 9/1966 | Filipak | F24C 7/06 219/403 |
| 3,281,575 | A | | 10/1966 | Ferguson, Jr. | |

(Continued)

FOREIGN PATENT DOCUMENTS

| | | | | |
|---|---|---|---|---|
| GB | 2057254 | | 4/1983 | |
| GB | 2117627 | A * | 10/1983 | A47J 37/0871 |
| JP | 2006292190 | A * | 10/2006 | |

*Primary Examiner* — Timothy L Maust

(74) *Attorney, Agent, or Firm* — Pearne & Gordon LLP

(57) ABSTRACT

A cooking appliance is provided having a cooking cavity with an opening defined at its base. The cooking appliance also includes a modular accessory that is reversibly receivable in said opening. The modular accessory defines a sump space that extends below the base of the cooking cavity through said opening. The modular accessory can be a modular sump; or it can be a steamer, a water-basin for steaming and/or sous-vide cooking, a holder for briquettes or wood chips used to smoke food, a plate-warming compartment, a pizza stone or a grill rack. The appliance can further include a heating element that extends outside and adjacent to a sidewall of said modular accessory, partially surrounding said modular accessory.

17 Claims, 6 Drawing Sheets

(56) References Cited

U.S. PATENT DOCUMENTS 3,523,181 A * 8/1970 Beasley ..... F24C 7/06 219/202
5,713,265 A 2/1998 Strader et al.
5,934,183 A * 8/1999 Schlosser ..... A47J 37/0786 126/25 R
6,008,478 A 12/1999 Crone et al.
6,166,353 A 12/2000 Senneville et al.
6,191,391 B1 2/2001 Deo et al.
6,285,009 B1 9/2001 Barnes et al.
6,362,458 B1 3/2002 Sargunam et al.
6,878,904 B2 * 4/2005 Verveniotis ..... A47J 37/0611 219/394
7,301,127 B1 * 11/2007 Derridinger, Jr. ... A47J 37/0709 219/386
7,527,051 B2 5/2009 Schmitz
7,781,702 B2 * 8/2010 Nam ..... F24C 15/166 219/386
8,263,909 B2 9/2012 Baek et al.
8,347,874 B2 * 1/2013 Bruno ..... A47J 37/0713 126/25 R
8,415,591 B2 * 4/2013 Boyer ..... F24C 15/00 219/392
8,669,498 B2 3/2014 Lee et al.
8,796,590 B2 8/2014 Boyer, III et al.
8,916,802 B2 12/2014 Bringe et al.
9,395,088 B2 7/2016 Wiggins et al.
2003/0070789 A1 * 4/2003 Mueller ..... F25D 19/00 165/61
2010/0089248 A1 * 4/2010 Jones ..... A47J 37/0641 99/444
2012/0167865 A1 7/2012 Winkelmann
2012/0266856 A1 * 10/2012 Zelek ..... A47J 37/067 126/25 R
2013/0312732 A1 * 11/2013 Brennan ..... A47J 37/07 126/25 R
2014/0026880 A1 1/2014 Froelicher
2014/0116268 A1 5/2014 Bigott
2015/0047623 A1 2/2015 Wiggins
2016/0095469 A1 * 4/2016 Gregory ..... A47J 36/32 426/233
2016/0195281 A1 * 7/2016 Chaturvedi ..... F24C 15/18 219/393
2017/0343221 A1 * 11/2017 Swayne ..... F24C 15/327

* cited by examiner

DEEP-EMBOSSED SUMP AND HEATING ELEMENT FOR AN OVEN

FIELD OF THE INVENTION

The present application relates generally to a deep-embossed sump for the cavity of an oven appliance. In general, a sump space within an oven cavity is formed of a base conjoined with sidewalls, which define a perimeter and a depth, alternately referred to as an "embossment", of the sump.

BACKGROUND OF THE INVENTION

Oven appliances typically include a relatively large unused space at the base of the oven cavity, referred to as the sump. Food cooked in the oven cavity typically rests on a rack within the oven cavity and not the floor of the cavity. So the space beneath the lowest rack-support level goes unutilized. The sump in the bottom of cavities has long been unusable space that simply added to the overall volume, or space taken up by the oven appliance.

Traditionally, a heating element is provided below the oven cavity. However, this placement of the heating element has the disadvantage of requiring additional vertical space.

It is common practice for manufacturers to provide sumps in the bottom of oven cavities anywhere from 1 to 3 inches deep for several reasons. For example, the space in a sump provides an increased overall capacity of the oven cavity, which may aid in heat retention or and water retention for steam functionality. Also, a sump can allow spills to be contained and cleaned up more easily. Finally, the structure of the sump can contribute to increased stiffness and structural stability in the oven cavity.

U.S. Pat. Nos. 8,415,591 and 8,796,590 are directed to an oven appliance having a low-temperature self-cleaning mode. The oven cavity includes a sump that is configured to retain a fluid such as water that is used in the low-temperature self-cleaning mode.

U.S. application Ser. No. 14/871,337, published as 2016/0095469, describes a powered cooking accessory for use inside of an oven cavity. The powered cooking accessory is recessed within a receiving portion of the lowest cooking rack. Although the powered cooking accessory could occupy some of the sump space in the bottom of the oven cavity, it is removably coupled to the lowest oven rack and not to the sump space itself. The powered cooking accessory comprises a vessel that can be a tray-like or pan-like and can include handles or a lid to enclose the vessel. The vessel can further include swappable components such as a steam tray and water basin, cooking stone, grill grates, grill pans, rotisserie rack or the like. The powered cooking accessory includes its own heating element that is coupled with a lower surface of the vessel.

Traditionally, a heating element, which is also sometimes referred to as a "bake element," is positioned at a base of the oven cavity, either within the cavity or below a base of the oven cavity, e.g. underneath the sump.

U.S. Pat. No. 6,008,478 and U.S. application Ser. No. 13/556,580, published as 2014/0026880, both describe oven appliances having a hidden heating element. For example, the '478 patent describes an oven appliance having a heating element enclosure that provides relatively easy access to a heating element hidden beneath the bottom wall of the oven cavity.

U.S. Pat. No. 6,285,009 describes an electric heating element having laterally spaced side legs interconnected by a front leg, each of the side legs having an inward bend.

BRIEF SUMMARY OF THE INVENTION

In accordance with one aspect, A cooking appliance is provided. The cooking appliance has a cooking cavity with an opening at its base. A modular accessory is also provided, and is reversibly receivable in the opening. The modular accessory defines a sump space that extends below the base of the cooking cavity through the opening. The sump space of the modular accessory utilizes and enlarges the space at the base of the oven cavity to provide additional cooking options to a user.

The modular accessory may be configured as a modular sump, or as another cooking accessory such as a steamer, a water-basin for steaming and/or sous-vide cooking, a holder for briquettes or wood chips used to smoke food, a pizza stone, a grill rack, or a separate temperature-controlled compartment.

In accordance with another aspect, a heating element may be provided surrounding at least a portion of the modular accessory for providing cooking power to the modular accessory. Such a heating element may enable incorporation of a sump without materially detracting from the available volume of a subjacent warming/storage drawer, and without adding to the total height of the oven appliance. This is because the heating element does not need to be lowered to accommodate the sump. Rather, the heating element extends substantially about a partial perimeter of the sump.

Second, positioning of the heating element about the perimeter of the modular accessory can reduce crazing of the base of the modular accessory. This is because the perimeter portion of the modular accessory can be thicker and more robust than the center of the base of the modular accessory, so that the perimeter is better able to withstanding crazing. Since the heating element is provided along a perimeter of the modular accessort where the walls are thicker and/or more robust, this can have the effect that less crazing occurs overall.

The heating element may be hidden from view when the modular accessory is held in place within the cavity. This increases the overall safety of the oven appliance, and may also contribute to a pleasing aesthetic.

DESCRIPTION OF EXAMPLE EMBODIMENTS

Figure 1:
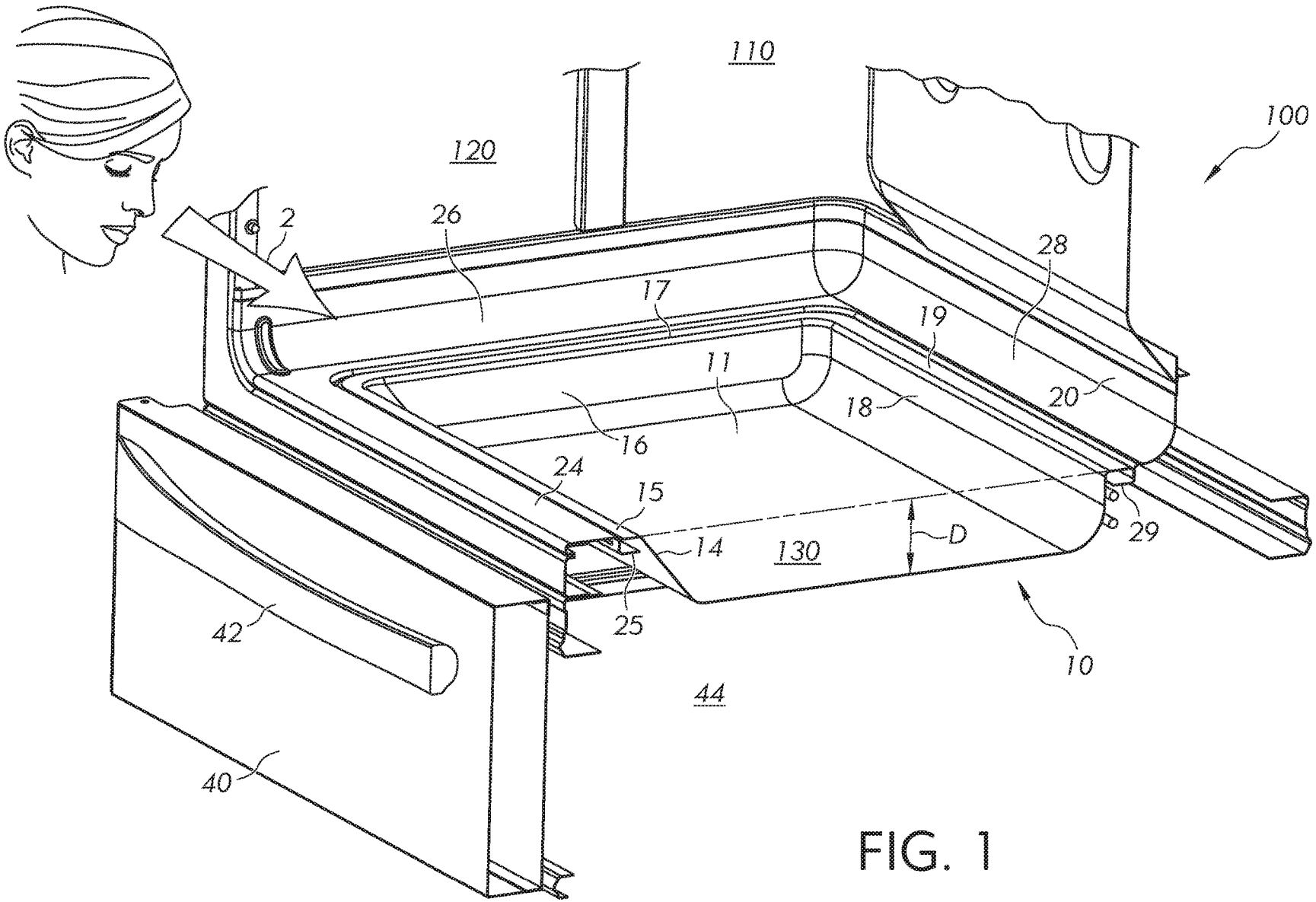
FIG. 1 is a perspective view of a cutaway portion of an oven appliance with an oven cavity containing a sump according to a first embodiment.

Example embodiments are described and illustrated in the drawings. These illustrated examples are not intended to be limiting. For example, one or more aspects or features can be utilized in other embodiments.

Figure 2:
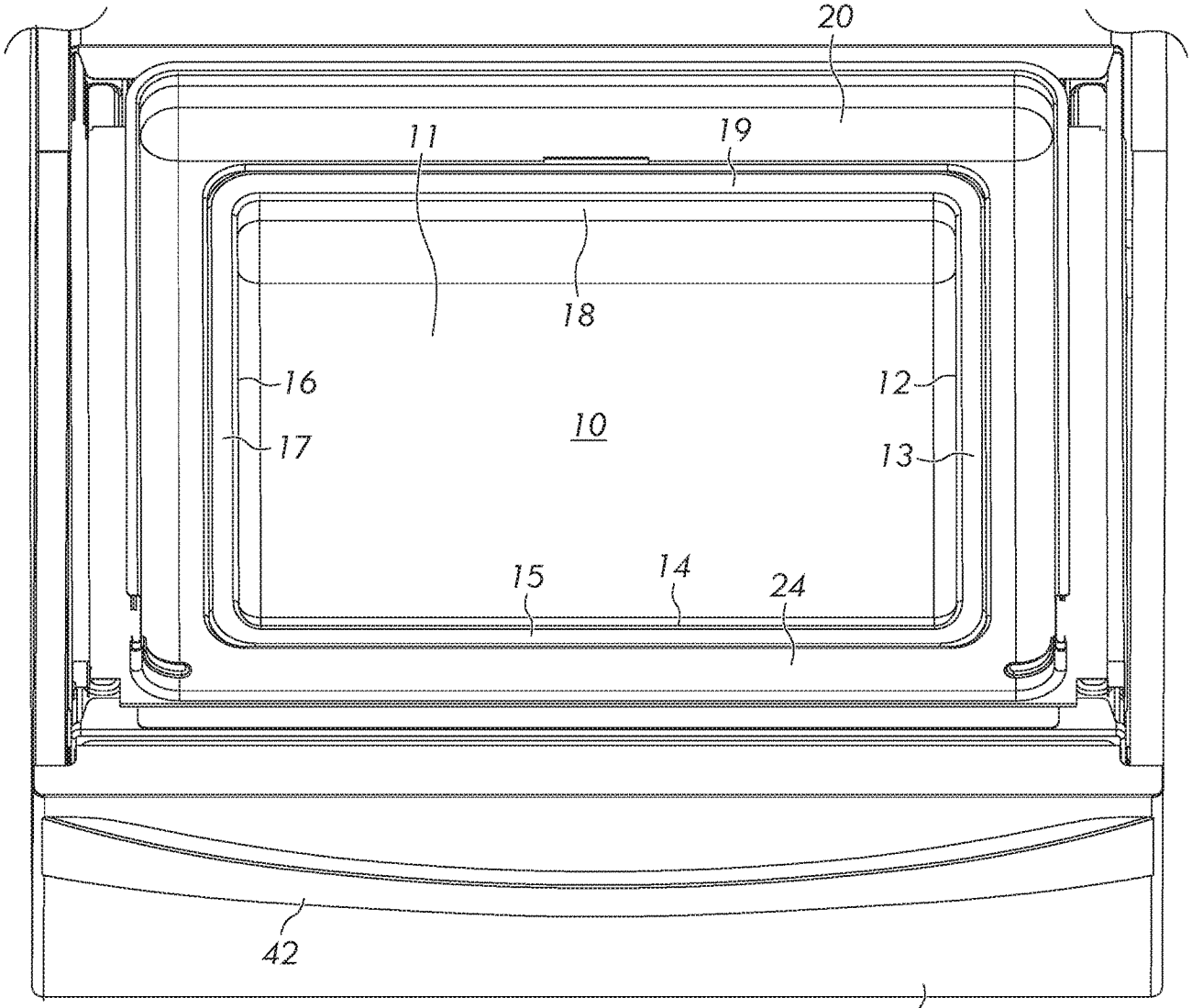
FIG. 2 is a top/front view taken from the perspective indicated by arrow 2 shown in FIG. 1, and shows the oven drawer and an interior of the oven cavity containing the sump of the first embodiment.

FIGS. 1 and 2 show an oven appliance 100 having a removable sump 10 at the base of the oven cavity 110, located above a subjacent space 44 with a warming drawer 40. In both figures, the door of the oven appliance 100 has been removed to better visualize the sump 10.

The oven appliance 100 has a cavity 110 comprising a main space 120 and a sump space 130. The sump space 130 is fluidly open to the main space 120 of the cavity 110 and enlarges the total volume of the cavity 110. The oven cavity 110 is enclosed by a top surface, a front surface, a back surface, left and right side surfaces, and a base or bottom surface. The oven cavity's 110 front surface preferably includes an oven door (not shown), which enables access to the oven cavity 110. The surfaces enclosing the oven cavity 110 are preferably conjoined, sealed and/or insulated so as to allow the oven cavity 110 to be efficiently heated to cooking temperatures. Some or all of the enclosing surfaces may be formed as separate surfaces and then joined together by welding, adhesives, snap-fit or screw closures, via a gasket seal, or any other known technique. Alternatively, some or all of the enclosing surfaces may be formed integrally using additive or subtractive manufacturing technologies. The surfaces forming the oven walls may be formed of various metals, ceramics, composite materials, or other materials able to withstand operating temperatures of the oven cavity 110. The edges connecting various ones of the oven surfaces may be angular or curved.

In any case, the oven appliance 100 should preferably be provided with at least one door in order to access the oven cavity 110. Preferably, the door is provided at the front of the oven appliance 100. The door may be attached to the oven appliance 100 via a hinge or sliding member.

The oven appliance 100 may be adapted to perform various cooking functions on food inserted into the oven cavity 110. Cooking functions may include baking, microwave cooking, steaming, toasting, broiling, grilling, smoking, convection cooking, gas cooking, and/or other functions. The oven appliance 100 may incorporate various heating elements (not shown) to carry out these or other cooking functions. The various heating elements may be located inside the oven cavity 110 or exterior to the oven cavity 110, for example in the vicinity of the surfaces enclosing the oven cavity 110. For example, heating elements may be located on an exterior face of one of the enclosing surfaces described above.

The oven appliance 100 further incorporates a subjacent space 44 beneath the oven cavity 110, where a drawer can be accommodated. The drawer may be used for warming food or plates, or for storage. As shown in the embodiment of FIGS. 1-2, the drawer may include a front panel 40 with a handle 42. In alternative embodiments, the subjacent space 44 may be provided in a manner other than accommodating a drawer, for example as a compartment with a hinged front door. Alternatively, the oven appliance 100 may be provided without any subjacent space 44.

According to the embodiment shown in FIGS. 1 and 2, the base 20 of the oven cavity 110 is substantially square extending about and defining a perimeter of the lower portion of the cavity 110, and has an arcuate surface form that provides a transition from a vertical alignment adjacent the respective enclosing surfaces of the oven cavity 110 to a substantially horizontal alignment along the edges of the bottom surface of the oven cavity 110. The base 20 can be composed of a frame or of panel elements joined to the front, back, left and right side surfaces of the oven cavity 110. Accordingly, the base 20 has a front portion 24, a back portion 28, and left and right side portions 22, 26. The portions 22, 24, 26, 28 of the base 20 are preferably conjoined, sealed and/or insulated so as to allow the oven cavity 110 to be efficiently heated to cooking temperatures. Some or all of the portions 22, 24, 26, 28 may be formed as separate surfaces and then joined together by welding, adhesives, snap-fit or screw closures, or any other known technique. Alternatively, the base 20 may be formed integrally as a single workpiece, using additive or subtractive manufacturing technologies. The surfaces forming the base 20 may be formed of various metals, ceramics, composite materials, or other materials able to withstand operating temperatures of the oven cavity 110. The edges connecting various ones of the portions 22, 24, 26, 28 of the base 20 may be angular or curved.

Together, these portions 22, 24, 26, 28 of the base 20 frame an opening in the bottom of the oven cavity 110 to receive and accommodate the removable sump 10. The front portion 24 is provided with a front base flange 25, and the back portion 28 is provided with a back base flange 29. Although the embodiment of FIGS. 1-2 provides base flanges 23, 25, 27, 29 on the respective portions 22, 24, 26, 28 of the base 20, alternative embodiments may include corresponding base flanges on fewer than all portions of the base 20.

The sump 10 is a basin or tub that is removably fitted at the base 20 of the oven cavity 110. The sump 10 encloses a sump space 130 defined by a lower wall 11 and perimeter side walls, namely a front sidewall 14, a back sidewall 18, and left and right sidewalls 12, 16. The height (preferably constant) of the perimeter sidewalls 12, 14, 16, 18 defines a depth D of the sump 10. The perimeter sidewalls 12, 14, 16, 18 may have various profiles, as shown in FIG. 1. The front sidewall 14 can be slanted or angled from top to bottom, whereas right and back sidewalls 16 and 18 preferably are substantially vertical above a curved transition to the lower wall 11. In alternative embodiments, other slanted, curved, or profiled configurations are contemplated for the perimeter sidewalls 12, 14, 16, 18 and for the lower wall 11. Furthermore, it is contemplated that the perimeter sidewalls 12, 14, 16, 18 may be provided with side racks, such as embossed side racks, to receive, stabilize, and/or accommodate one or more modular accessories.

At the top of each sidewall 12, 14, 16, 18, a perimeter flange 13, 15, 17, 19 is provided for resting on the complementary base flanges 23, 25, 27, 29 around the opening at the base 20 of the oven cavity 110. Together, these perimeter flanges 13, 15, 17, 19 of the sump 10 are complementary to and cooperate with the base flanges 23, 25, 27, 29 around the opening in the base 20 of the oven cavity 110 to support and accommodate the sump 10 in that opening.

The lower wall 11 and sidewalls 12, 14, 16, 18 enclosing the sump space 130 are preferably conjoined, sealed and/or insulated so as to allow the oven cavity 110 to be efficiently heated to cooking temperatures. Some or all of the walls of the sump 10 may be formed as separate pieces and then joined together by welding, adhesives, snap-fit or screw closures, or any other known technique. Alternatively, the sump 10 may be formed integrally as a single workpiece, using additive or subtractive manufacturing technologies. The walls of the sump space 130 may be formed of various metals, ceramics, composite materials, or other materials able to withstand operating temperatures of the oven cavity 110. The edges connecting various ones of the walls may be angular or curved.

Although the sump 10 of the first embodiment has a form that is substantially in the shape of a rectangular prism, other sump forms are also contemplated. In other forms, certain ones of the sidewalls may be joined into a single curved surface to form, for example, a cylindrical or pancake-shaped sump or an irregularly shaped sump space 130. Alternatively, any number of sidewalls may be provided along the perimeter of the sump 10 to define a sump space 130 in the shape of a polygonal prism. Alternatively, the sump may possess an inverted dome shape comprised primarily of an arcuate bottom wall that extends upward toward and defines the perimeter of the sump opening; alternatively such an arcuate wall may cooperate with one or more substantially planar side walls to define other-shaped sump spaces 130.

In any case, a depth D of the sump 10 is defined in the embodiment shown in FIGS. 1 and 2 by a height of the sidewalls 12, 14, 16, 18, which preferably are thicker and more robust than the lower wall 11 of the sump 10.

To remove the sump 10, it is simply lifted off the supporting complementary flanges 23, 25, 27, 29 and unseated from the opening in the base 20 of the oven cavity 100. Other connections between the sump 10 and the base 20 are also contemplated. For example, a slide-fitting or rail-type connection or a snap-fit connection could be provided, alternatively or in addition to the complementary flanges of the first embodiment.

In an alternative embodiment, the base 20 may be conjoined with the sump 10. In other words, the base 20 and sump 10 may be provided as a single, integrally formed component, or they may be permanently attached to each other. In this case, the sump 10 is not readily removable from the oven cavity 110.

Figure 3:
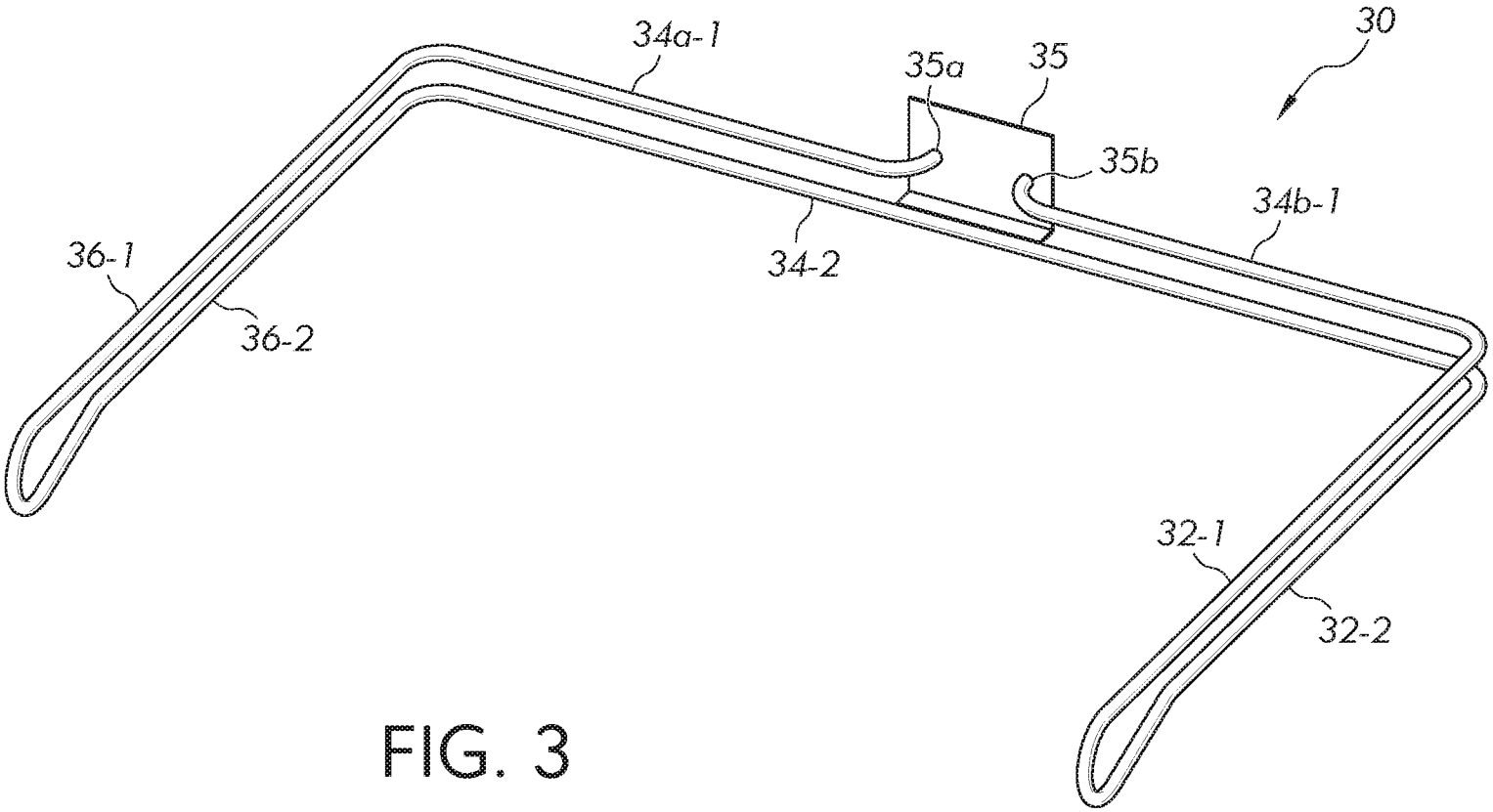
FIG. 3 is a perspective view of a heating element for heating the sump of the first embodiment.
Figure 4:
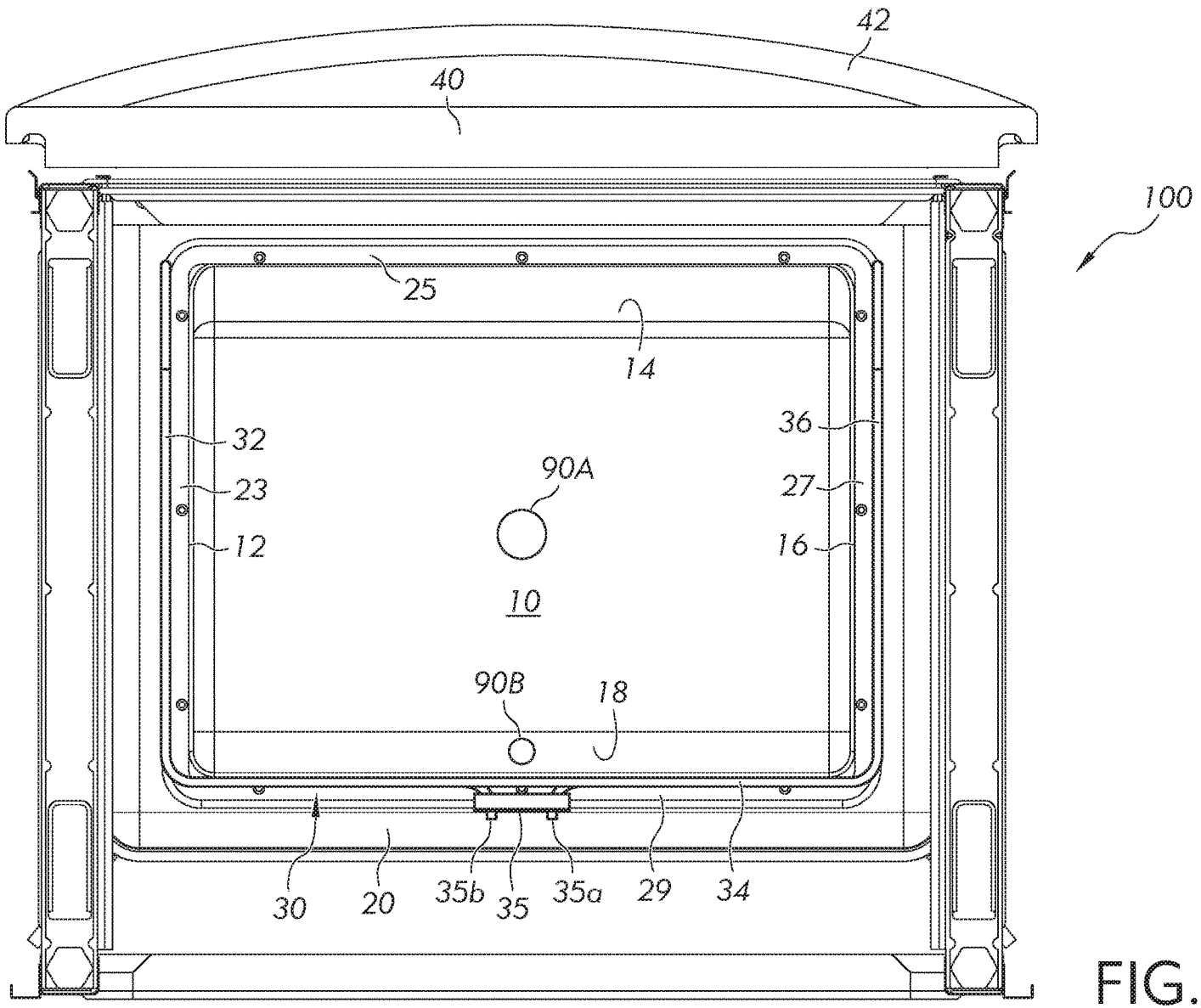
FIG. 4 is a bottom view of the oven appliance according to the first embodiment, showing the sump and the surrounding heating element.
Figure 5:
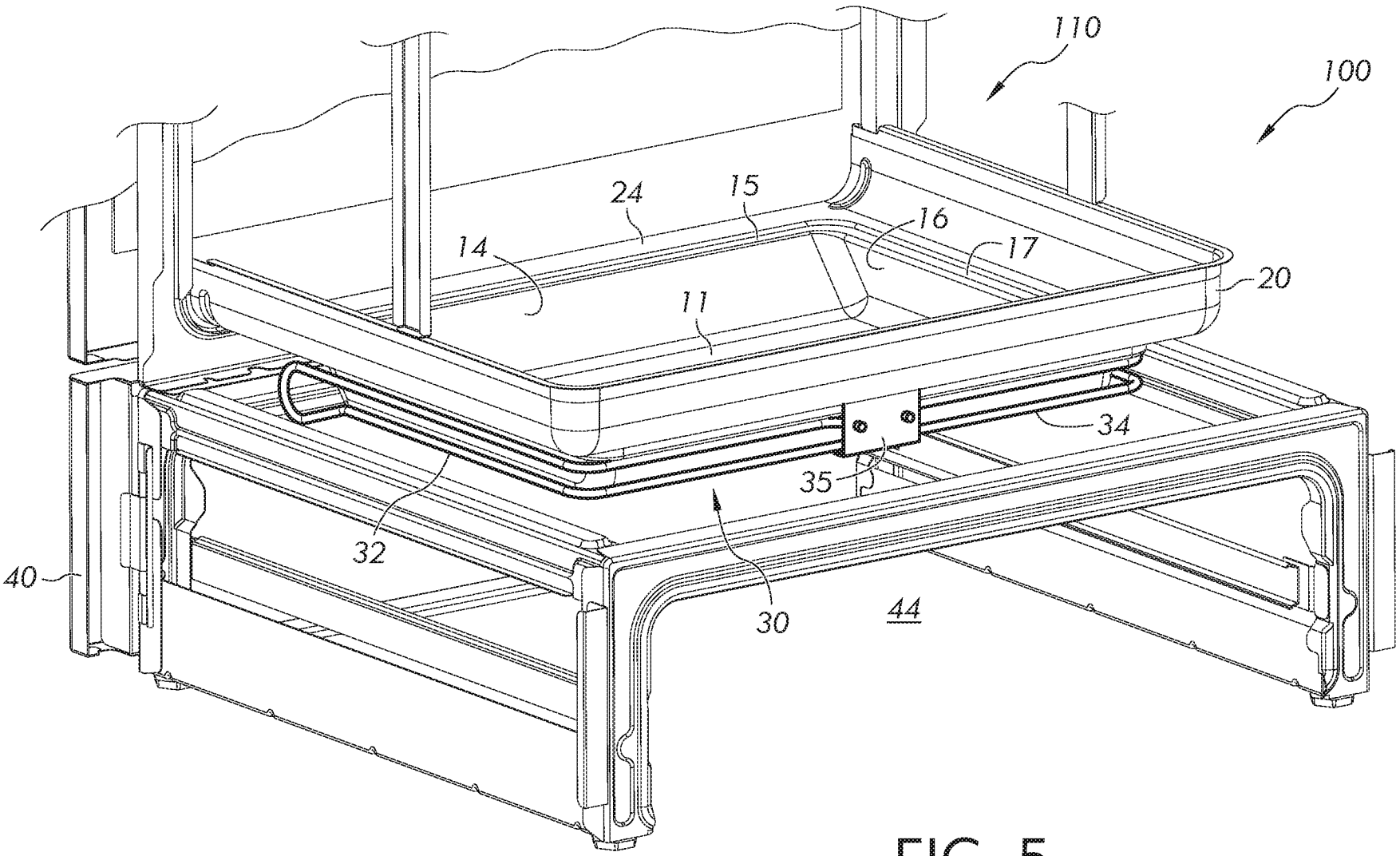
FIG. 5 rear perspective view of the oven appliance of the first embodiment partially cutaway to reveal the sump surrounded by the heating element.

In any case, incorporating the sump 10 within the oven cavity 110 will reduce the amount of available space below the cavity 110 for subjacent elements. This is true regardless of whether the sump 10 is integrated with the base 20 or supplied as the removable sump 10 shown in FIGS. 1-2. The elements located in the subjacent space 44 below the oven cavity 110 can include a warming or storage drawer 40. To accommodate the sump 10, a heating element 30 can be provided as seen in FIGS. 3-5. The heating element is located entirely above the subjacent space 44 where the drawer 40 is located.

As shown in the embodiment of FIG. 3, the heating element 30 extends outside and adjacent to side walls of the sump 10; more particularly, the heating element 30 conforms to a substantially U-shaped configuration surrounding the side walls 12, 16, 18 of the sump 10. The element 30 includes a mounting bracket 35, which in use is located behind the back sidewall 14 of the sump 10. First and second ends 35*a* and 35*b* of a wire forming the heating element 30 (e.g. calrod) can be supported by or attached to the bracket 35. Preferably the length of the heating element 30 forms a loop capable of carrying a current to generate heat via resistance heating, and is bent into the U-shaped conformation as shown. The heating element 30 is preferably formed of a rigid material such as nichrome wire or other resistive element. Specifically, resistive wire or coil extends from its first end 35*a* to form a first top back part 34*a*-1, is then fed along top left part 36-1 and doubles back along lower left part 36-2, then traces the lower back part 34-2 before curving into the lower right part 32-2, and loops back up to trace top right part 32-1, and is finally fed along the second top back part 34*b*-1 before terminating at the second end 35*b* at the bracket 35. The heating element 30 is preferably formed of a single length of resistive wire or coil.

The U-shaped element 30 substantially surrounds the sump 10 as seen in the bottom view of FIG. 4. As shown in this Figure, the arms of the heating element 32, 36 may be located under the base portion 20 at a distance from left and right sidewalls 12, 16 of the sump 10. Specifically, the arms of the heating element 32, 36 may be located under the left and right complementary flanges 23, 27 of the base 20, so that the base 20 shields and protects the user from these portions of the heating element 30, even if the sump 10 is not seated on the base 20. When the sump 10 is seated on the base 20, then the heating element 30 is completely hidden from view.

In alternative embodiments in which the sump 10 does not have a rectangular perimeter, the heating element 30 may take forms other than the form shown in FIG. 3, so as to substantially surround the sidewalls of the sump 10. For example, if the sump 10 has a circular sidewall, then the heating element 30 may be formed in the shape of an arc enclosing part or all of the circle. The same applies analogously to sumps 10 with a polygonal or irregular perimeter shape.

In any case, the heating element 30 does not need to be formed of resistive wire or coil in a looped configuration. In alternative embodiments, it is contemplated that a spiral configuration or a non-looped configuration be provided, for example by enclosing the loop in a casing or housing or by using other types of heating elements that do not depend on a circuit-shaped configuration. For example, it is contemplated that the first and second ends 35*a*, 35*b* could be split up, and provided at respective terminal ends of the arms of the U-shape, so that a single length of coil (rather than the doubled-up length of coil shown in the first embodiment) would trace the form of the U.

In any case, the U-shaped heating element 30 is preferably open toward the front of the oven cavity 110. In other words, the heating element 30 preferably does not enclose the front sidewall 14 of the sump 10. This may make it easier for the sump 10 to be inserted and removed in the base 20, and also should avoid delivering excess heat to elements of the door adjacent the front sidewall 14, which otherwise might cause a hazard to the user.

The heating element 30 as described can have several advantages. First, it may enable incorporation of the sump 10 without materially detracting from the available volume of the warming/storage drawer 44. This is because the heating element 30 does not need to be shifted to a lower position to accommodate the sump 10. Rather, the heating element 30 extends substantially about a partial perimeter of the sump 10, and therefore does not take up additional vertical space within the oven appliance 100.

A second advantage of positioning the heating element 30 around the perimeter of the sump 10 is that crazing of the lower wall 11 of the sump 10 can be reduced. Crazing occurs when fine cracks form on the surface of a material, for example due to thermostatic stresses from applied heat. Because the sidewalls 12, 14, 16, 18 along the perimeter of the sump 10 are preferably thicker and more robust than the lower wall 11, the sidewalls 12, 14, 16, 18 may be better able to withstanding crazing. Accordingly, positioning the heating element 30 around the perimeter of the sump 10 may allow the overall robustness and useful life of the sump 10 to be extended.

Notably, the U-shaped heating element 30 can be used both with a modular, removable sump 10 as seen in the above embodiment, as well as with an oven cavity 110 having an integrated sump 10. The U-shaped heating element 30 can be used to supply cooking power to a variety of modular/interchangeable accessories, as described below, whether the accessories are seated within the sump 10 or in the opening of the base 20 in place of the sump 10.

Figure 6:
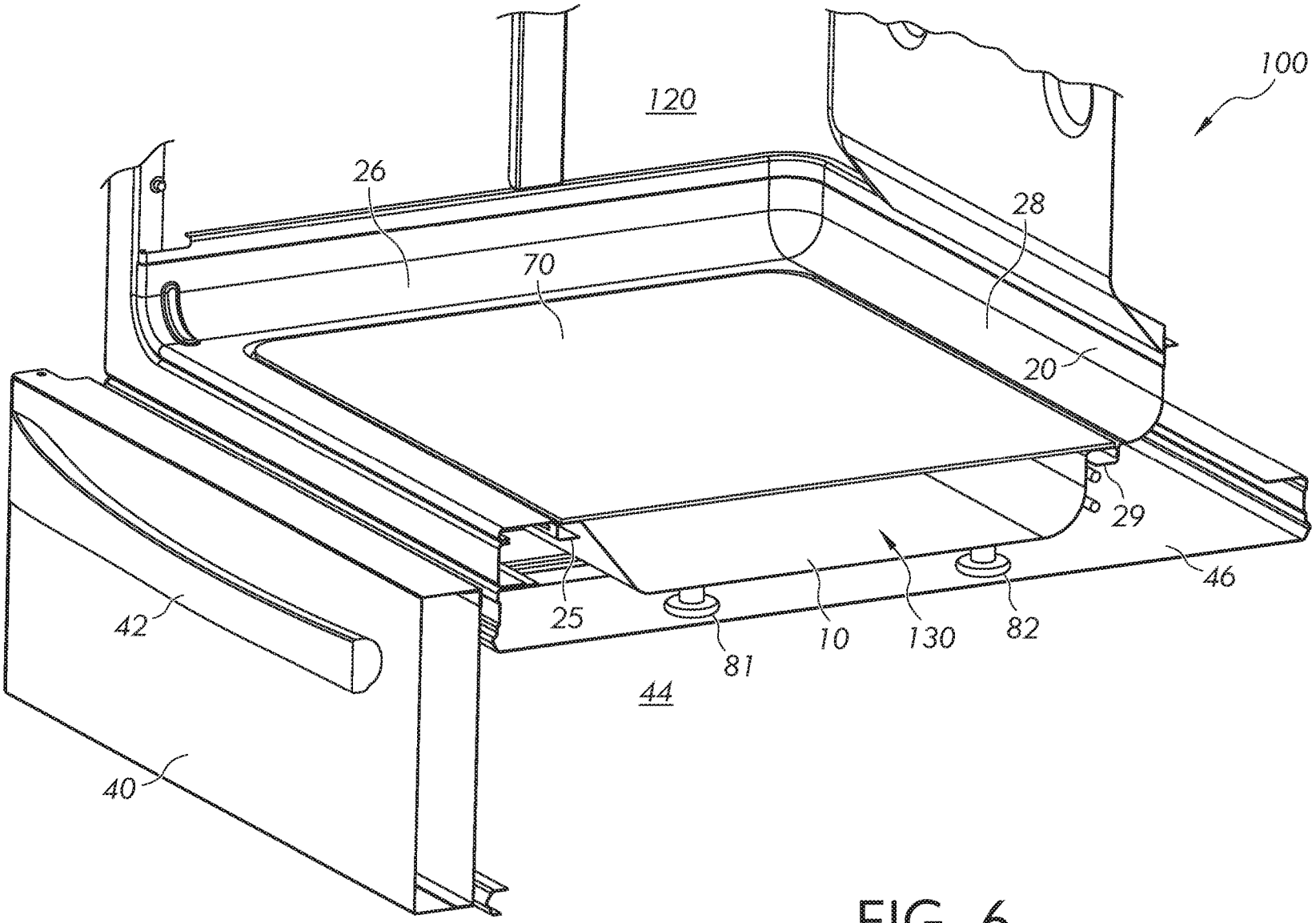
FIG. 6 is a perspective view of a cutaway portion of an oven appliance having a modular accessory according to a further embodiment.

In a further embodiment shown in FIG. 6, a modular accessory 10' in the form of a plate warmer is provided. The modular accessory 10' is received and seated in the sump space 130 through the opening in the base 20 of the oven cavity 110. Like the sump 10 of the first embodiment, the modular accessory 10' includes perimeter flanges 13, 15, 17, 19 that are complementary to base flanges 23, 25, 27, 29 at the base 20 of the oven cavity 110, in order to be received and seated therein.

The modular accessory 10' is illustrated as a plate warmer, wherein serving plates can be placed within the accessory either before or after it has been seated in the sump space 130. In this embodiment the heating element 30 can be operated independently of the other heating elements used for cooking food in the oven cavity 110, in order to separately heat plates within the accessory 10' to a desired serving temperature. A lid 70 may be provided to close off the accessory 10' from the main space 120 of the oven cavity 110.

Alternatively, the accessory 10' also can be any one of a variety of other accessories such as, for example: a steamer having a grate for suspending food to be steamed above a small reservoir of water at the base of the accessory and a lit for containing steam within, a water-basin to carry out water-based sous-vide cooking or cheesecake baking in the sump space, a water-basin to facilitate steam cooking of food products resting on racks above the basin, a cavity containing racks to hold briquettes or wood chips for smoking, or a plate-warming compartment as illustrated or other compartment that can be separately temperature-controlled. Notably, the sump 10 of the first embodiment can itself be utilized to function as various ones of the modular accessories listed above. For example, the sump 10 can be used as a water basin for steaming or for water-based sous-vide cooking, by filling the sump 10 at least partially with water and utilizing the heating element 30 to regulate the temperature of the water therein, or to convert it to steam. Alternatively, the sump 10 can be used as a carrier to hold briquettes for smoking food.

In an alternative embodiment, the aforementioned modular accessories can be configured to fit within the removable sump 10 of the first embodiment. In this case, the sump 10 can be provided with interfacial supporting structures (not shown). In any case, one or more of the modular accessories may be provided with one or more feet 81, 82 configured to rest on either the lower wall 11 of the sump 10 when the accessory is configured to be supported therein, or on a dividing wall 46 below the sump space 130 when the accessory 10' is configured to be received in the opening defined at the oven-cavity base 20.

In any case, temperature sensors 90A, 90B (as shown in FIG. 4) may be provided on or in the vicinity of the modular accessory 10', to allow the temperature of said modular accessory to be monitored. Alternatively or in addition, heating of the sump 10 and/or of the modular accessory 10' may be controlled, via the heating element 30, separately from or in addition to heating of a main space 120 of the oven cavity 110.

Optionally, other modular accessories such as a pizza stone or grill/grate can be supplied as accessories. These may be supported on the support flanges 23, 25, 27, 29 surrounding the opening in the base 20 of the oven cavity 110, to provide additional functional surface within the oven cavity 110 for cooking or grilling. In these embodiments, a subjacent hidden-bake element (not shown), or the element 30 if so configured, can additionally be provided beneath the accessories to supply cooking power.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A cooking appliance comprising:

a cooking cavity having a main cavity opening through which food to be cooked can be inserted into the cavity, the main cavity opening being reversibly closable by a door, said cavity further having a base opening defined at a base of the cooking cavity;

a modular cooking accessory reversibly receivable in said base opening, said modular cooking accessory defining an open-topped sump space therein that extends below the base of the cooking cavity through said base opening, said open-topped sump space being in open fluid communication with the cooking cavity, said modular cooking accessory being removably insertable through said main cavity opening to be inserted and received in said base opening of the cavity.

2. The cooking appliance of claim 1, the modular cooking accessory being a modular sump.

3. The cooking appliance of claim 1, said modular cooking accessory being selected from the group consisting of: a steamer, a water-basin for steaming and/or sous-vide cooking, a holder for briquettes or wood chips used to smoke food, a plate-warming compartment, a pizza stone and a grill rack.

4. The cooking appliance of claim 1, the base of the cooking cavity comprising supports and the modular cooking accessory comprising a complementary structure, such that the modular cooking accessory can be removably seated on said supports.

5. The cooking appliance of claim 4, wherein the supports comprise one or more flanges and the complementary structure comprises one or more complementary flanges.

6. The cooking appliance of claim 4, wherein the supports comprise a shelf and the complementary structure comprises one or more feet adapted to rest on said shelf.

7. The cooking appliance of claim 1, said cooking appliance comprising a heating element having at least one leg configured to extend outside and adjacent to a sidewall of said modular cooking accessory.

8. The cooking appliance of claim 7, said heating element being configured to at least partially surround said modular cooking accessory.

9. The cooking appliance of claim 7, wherein no portion of the heating element is located in a subjacent space beneath a bottom wall of said modular cooking accessory when said modular cooking accessory is received in said opening.

10. The cooking appliance of claim 7, the heating element comprising a plurality of legs that define a U-shape and surround the modular accessory along a back wall and two side walls of said modular cooking accessory.

11. The cooking appliance of claim 7, the heating element being configured to not extend adjacent a front wall of the modular cooking accessory.

12. The cooking appliance of claim 7, further comprising a drawer located subjacent to the cooking cavity.

13. The cooking appliance of claim 12, said heating element being located entirely above said drawer.

14. The cooking appliance of claim 7, the heating element being hidden from view when said modular cooking accessory is received in said opening.

15. The cooking appliance of claim 1, said open-topped sump space being fluidly open to and enlarging the volume of the cooking cavity.

16. A cooking appliance comprising:

a cooking cavity having a main cavity opening through which food to be cooked can be inserted into the cavity, the main cavity opening being reversibly closable by a door, said cavity further having a base opening defined at a base of the cooking cavity;

an open-topped sump extending below the base of the cooking cavity and being in open fluid communication therewith through said base opening, said open-topped sump being removably insertable through said main cavity opening to be inserted and received in said base opening of the cavity, and a heating element having at least one leg configured to extend outside and adjacent to a sidewall of said sump and located below the base of the cooking cavity.

17. The cooking appliance of claim 16, said heating element being configured to at least partially surround said open-topped sump.

* * * * *